US005219039A

United States Patent [19]

Bell

[11] Patent Number: 5,219,039

[45] Date of Patent: Jun. 15, 1993

[54] FALL PREVENTION SYSTEM FOR BILLBOARDS

[76] Inventor: Michael Bell, 1705 Triumphe Way, Warrington, Pa. 18976

[21] Appl. No.: 871,866

[22] Filed: Apr. 20, 1992

[51] Int. Cl.[5] ..... A62B 35/00

[52] U.S. Cl. ..... 182/3; 182/112

[58] Field of Search ..... 182/3, 4, 112, 113, 182/107

[56] References Cited

U.S. PATENT DOCUMENTS

| | | | |
|---|---|---|---|
| 3,672,466 | 6/1972 | Beck | 182/3 |
| 4,037,824 | 7/1977 | Whitmer | 182/3 X |
| 4,674,596 | 6/1987 | Weiner et al. | 182/3 |
| 5,036,949 | 8/1991 | Crocker et al. | 187/3 |

*Primary Examiner*—Alvin C. Chin-Shue

*Attorney, Agent, or Firm*—Caesar, Rivise, Bernstein, Cohen & Pokotilow, Ltd.

[57] ABSTRACT

A system for preventing a worker from falling off of a billboard. The system comprises a safety rope and a pair mounting assemblies formed of interconnected links. Each mounting assembly is mounted adjacent a respective side of the billboard and comprises a connector connected between the links for securing the rope thereto. Each of the mounting assemblies is movable between and stowed position and an extended position and vice versa. Each connector is located closely adjacent the rear surface of the billboard when its associated mounting assembly is in the stowed position, and is located spaced in front of the front of the billboard when its associated mounting assembly is in the extended position. The rope is connected tautly between the connectors when the mounting assemblies are in the extended position to serve as a sliding anchor point to which a safety device, e.g., safety belt or harness, worn by a worker may be releasably secured.

10 Claims, 3 Drawing Sheets

FALL PREVENTION SYSTEM FOR BILLBOARDS

BACKGROUND OF THE INVENTION

This invention relates generally to safety apparatus and more particularly to a device for mounting on a billboard to enable a worker to be connected thereto to prevent the worker from falling.

As a result of the enactment of various safety laws persons working at elevated height positions are required to be protected against falls. One common approach to achieve that end is the use of a safety line or cable which is connected to a fixed anchor point on the building and which is dropped down to the ground so that it extends between the elevated position and the ground. This line may serve as a line on which a conventional "rope grab" device or a conventional lowering device, e.g., a SKY GENIE (Registered Trademark) device sold by Descent Control, Inc. of Fort Smith, Arkansas, is mounted.

Persons working on elevated billboards frequently have to move about the billboard to complete their tasks, e.g., to completely paper the billboard with the advertising materials. While the use of a conventional safety line connected to a fixed anchor will adequately protect the worker from a fall, it tends to inhibit his/her freedom of movement.

The prior art has not addressed the foregoing problem in an adequate manner heretofore.

OBJECTS OF THE INVENTION

Accordingly, it is a general object of this invention to provide a safety system which overcomes the disadvantages of the prior art.

It is a further object of this invention to provide a fall protection system for billboards which protects a worker from a fall, while providing substantial freedom of movement by the worker on the billboard.

It is a further object of this invention to provide an fall prevention system for billboards which is easy to use by a worker to protect him/her from a fall.

It is a further object of this invention to provide a fall prevention system for billboards which is simple in construction.

It is still a further object of this invention to provide a fall prevention system for billboards which can be permanently mounted thereon.

It is yet a further object of this invention to provide a fall prevention system for billboards which can be permanently mounted thereon in a stowed, low visibility, position, but which can be moved to an operative position so that when a worker desires to be protected from a fall he/she can be readily connected thereto.

SUMMARY OF THE INVENTION

These and other objects of this invention are achieved by providing a safety system for preventing a worker from falling off of a billboard. The billboard has a front surface, a rear surface, and a pair of sides. The system comprises safety rope means, and a pair mounting assemblies. Each of the mounting assemblies is mounted adjacent a respective side of the billboard and comprising connector means for securing the safety rope means thereto.

Each of the mounting assemblies is movable between a stowed position and an extended position and vice versa. The connector means is located closely adjacent the rear surface of the billboard when its associated mounting assembly is in the stowed position, and is located spaced in front of the front surface of the billboard when its associated mounting assembly is in the extended position. The rope means is connected between the connector means, e.g., it is substantially taut, whereupon when so connected it serves as an anchor to which a safety device worn by a worker may be releasably secured.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
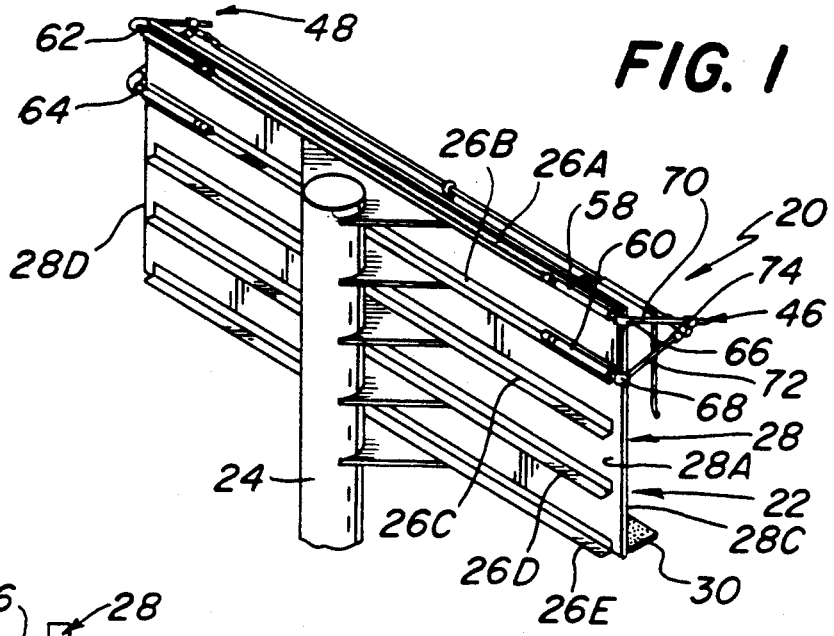
FIG. 1 is a rear isometric view of a conventional billboard having a fall prevention system constructed in accordance with this invention mounted thereon.

Referring now to the drawing where like reference numerals refer to like parts there is shown at 20 in FIG. 1, a fall prevention safety system constructed in accordance with this invention mounted on a conventional billboard 22. The billboard 20 includes a center post 24 to which is connected plural horizontally disposed angle braces 26A–26E for supporting the billboard panel 28 thereon. The angle braces 26A–26E are fixedly secured, e.g., welded, to the back surface 28A of the billboard panel 28. The panel includes a front surface 28B (FIG. 2) upon which the advertising materials are placed, and a pair of side edges 28C and 28D. A support ledge 30 is mounted along the bottom edge of the panel 28 and projects outward in the front of the billboard panel for a worker 32 (FIG. 3) to stand or place a ladder 34 (FIG. 3) so that he/she can move about the front surface of the billboard to paper or paint it with the advertising materials.

The fall prevention system 20 is arranged to serve as a means to which the worker 32 can connect himself/herself to prevent a fall off of the billboard. To that end the system 20 is arranged to be used by the worker 32 wearing any conventional safety device, e.g., a waist belt 36 or harness (not shown), to which is connected a lanyard 38. The lanyard is in turn connected to a safety rope 40, via a sliding connector 24, e.g., a conventional ring mounted on the rope to slide therealong. The safety rope and sliding connector also form a portion of the fall prevention system 20. The rope 40 is arranged to be strung tautly across the front of the billboard panel (as will be described later) so that the sliding connector can be slid along the rope across the full width of the billboard.

In accordance with a preferred use of this invention the lanyard 38 includes a conventional retraction mechanism 44, similar to a automobile seat belt retractor, to keep the length of the lanyard to a minimum, thereby minimizing the shock to the worker if he/she should fall until the slack in the lanyard is taken up. One particularly effective retractable lanyard is that sold by Aros, Inc. of Salt Lake City, Utah under the trade designation AROS G-TRACT.

Figure 2:
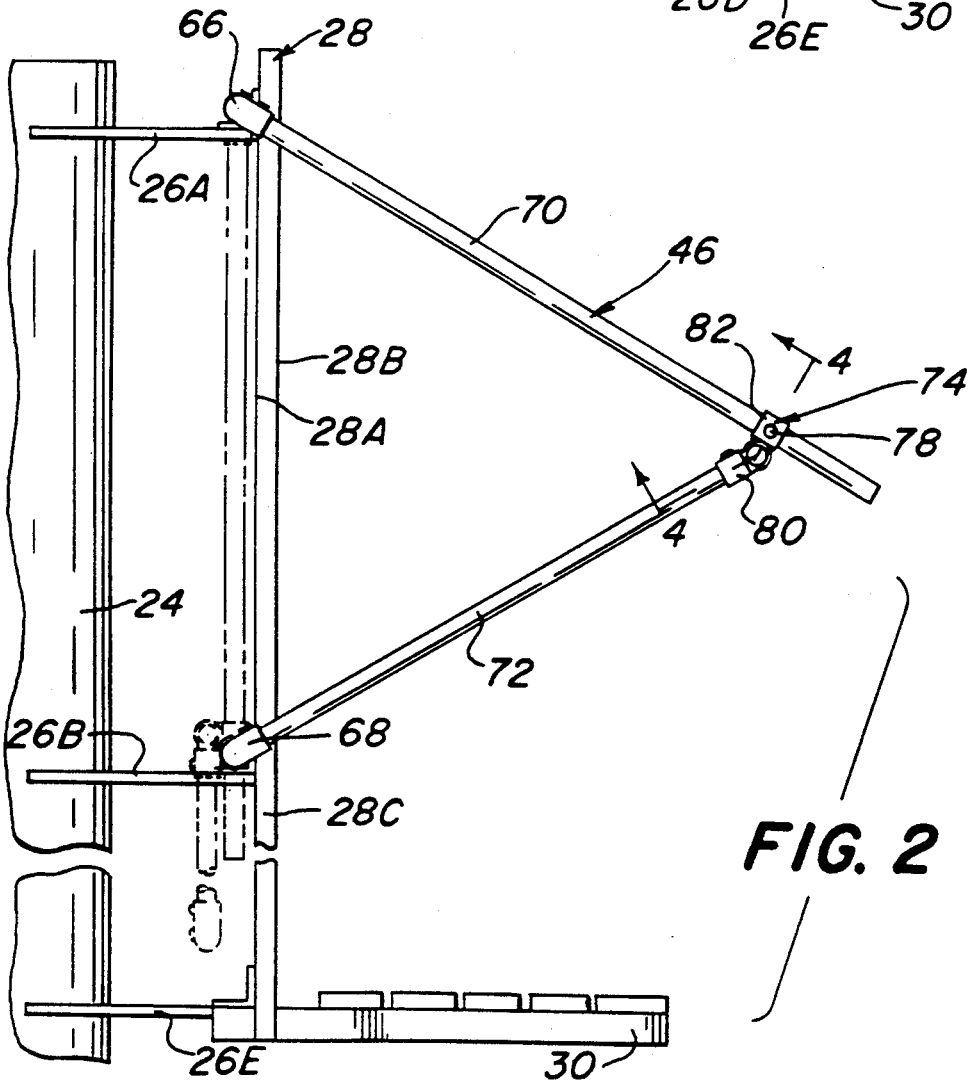
FIG. 2 is an enlarged side elevational view of the billboard with the fall prevention system shown in FIG. 1.
Figure 3:
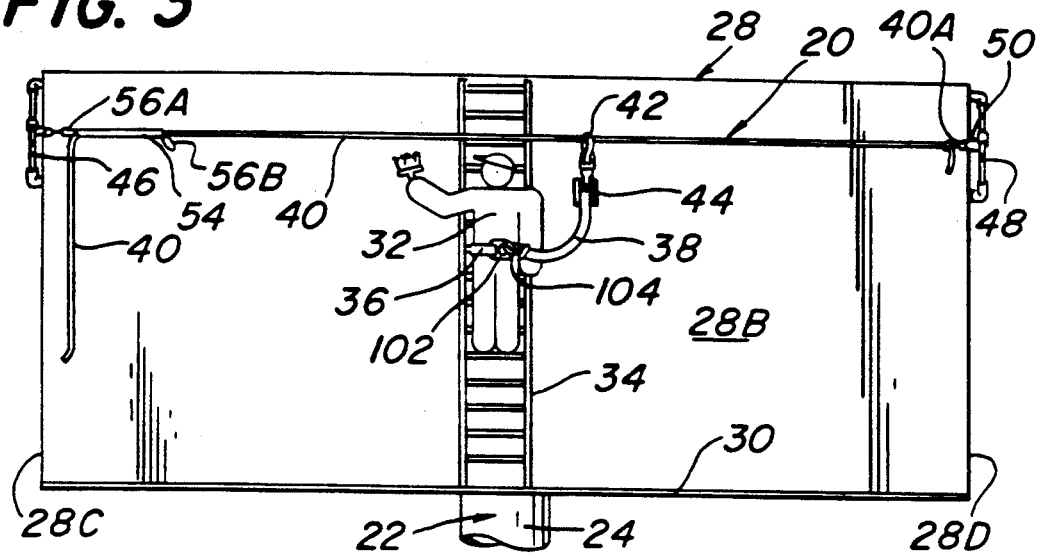
FIG. 3 is front plan view of the billboard and fall prevention system shown in FIG. 1 protecting a worker from falling thereof.

Referring now to FIGS. 1 and 3 it can be seen that the fall prevention system 20 basically comprises the heretofore identified safety rope or line 40 and a pair of mounting assemblies 46 and 48. One mounting assembly 46 is mounted on a pair of angle braces 26A and 26B on the rear of the billboard panel adjacent the side 28C, while the other mounting assembly 48 is mounted on the same angle braces adjacent the other side 28D of the billboard. Each of the mounting assemblies will be described in detail later. Suffice it for now to state that each is arranged to be moved from a retracted or stowed position immediately adjacent the side of billboard, as shown by the phantom lines in FIG. 2, to an extended position where portions of it are disposed to the front of the billboard, as shown by the full lines in FIGS. 1, 2 and 3.

As mentioned earlier, the safety line or rope 40 is arranged to be connected between the mounting assemblies 46 and 48 on each side of the billboard 22 and pulled so that it is taut therebetween. The rope 40 thus preferably includes a spliced eye 40A at one end thereof for connection, via a conventional carabiner 50, to a D-ring (to be described later) of a connector member 52 forming a portion of the mounting assembly 48. The other end of the rope 40 may be connected to the other mounting assembly 46 in various ways. For example, if the rope 40 is of the same length as the spacing between the two mounting assemblies 46 and 48, and if it includes a spliced-eye at its other end it may be connected to the mounting assembly 46 in the same manner as its first end is connected to the mounting assembly 48 so that the rope is relatively taut between the two assemblies. More likely an indeterminant length of rope 40, longer than the distance between the two mounting assemblies 46 and 48, will be used. In such a case a frictional engagement connector 54 is utilized as the means for connecting the rope 40 to the mounting assembly 46.

The frictional engagement connector 54 preferably comprises the means disclosed in my copending U.S. patent application Ser. No. 07/834,421 filed on Feb. 12, 1992, entitled Safety System For Use In Erecting Static Structures, whose disclosure is also incorporated by reference herein. That device will be described later. Suffice it for now to state that the frictional engagement connector 54 is a tubular member through which the rope 40 extends and includes a pair of ends 56A and 56B (FIG. 3), each of which is in the form of a respective loop. When the ends 56A and 56B of the frictional engagement member 54 are pulled away from each other the connector frictionally engages the rope passing therethrough to releasably secure it to the rope.

In order to secure the rope 40 to the mounting assembly 46, the frictional engagement connector 54 is mounted on the rope 40, the rope pulled taut and the frictional engagement connector is slid to a position on the rope immediately adjacent the mounting assembly 46. The frictional engagement connector 54 is then fixed in position on the rope by pulling its opposite looped ends 5AA and 56B apart. Depending upon the orientation of the frictional engagement connector 54 on the rope, either of its loops 56A or 56B can be connected, via a carabiner 50, to a D-ring (to be described later) forming a portion of the mounting assembly 46. In the embodiment shown in FIGS. 3 and 4, the loop 56A is connected via the carabiner 50 to the D-ring of the mounting assembly 46.

The mounting assemblies 46 and 48 are of an identical construction to each other. Thus, only the mounting assembly 46 will be described in detail hereinafter. As can be seen in FIGS. 1, 2, 5, and 6 the mounting assembly 46 basically comprises an upper fixed mounting tube 58, a lower fixed mounting tube 60, an upper rotatable mounting tube 62, a lower rotatable mounting tube 64, an upper 90 degree elbow pipe fitting connector 66, a lower 90 degree elbow pipe fitting connector 68, an upper tubular link 70, a lower tubular link 72, and a pivot coupling 74. The upper mounting tube is an elongated hollow member which is disposed horizontally on the uppermost angle brace 26A and is welded to that brace and the rear surface of the billboard panel by weldments 76 (FIG. 6). The lower mounting tube is also an elongated hollow member which is disposed horizontally on the next lower angle brace 26B and is welded to that angle brace and the rear surface of the billboard panel in a similar manner as the upper mounting tube. The upper rotatable mounting tube 62 is disposed within the hollow interior of the upper fixed mounting tube 58 so that it may rotate therein about the central longitudinal axis of the upper mounting tube. The lower rotatable mounting tube 64 is disposed within the hollow interior of the lower fixed mounting tube 60 so that it may rotate therein about the central longitudinal axis of the lower mounting tube.

One end of the upper elbow 66 is fixedly secured, via a set screw 78 (FIG. 5), to the outside end of the upper rotatable mounting tube 62. The corresponding end of the lower elbow 6 is arranged to be releasably secured to the outside end of the lower rotatable mounting tube 6 when the mounting assembly is in the extended position, as will be described in detail later.

The other end of the upper elbow 66 is fixedly secured, via a set screw 78 (FIG. 5), to the upper end of the upper tubular link 70. The upper tubular link comprises an elongated tube, whose lower end is connected to the coupling 74 (FIG. 2). The coupling basically comprises a female swivel socket pipe fitting 80 and a male single swivel socket pipe fitting 82. As can be seen clearly in FIGS. 2 and 4 the male socket fitting 82 is fixedly secured, via a set screw 78, to the lower end of the upper tubular link 70. The female socket fitting 80 is connected to the upper end of the lower tubular link 72 via a similar set screw. The male socket fitting 82 is connected to the female socket fitting 80 via a pin 84 so that the upper and lower tubular links 70 and 72, respectively, can pivot with respect to each other about the longitudinal axis of the pin. The pin 84 includes an enlarged head 86 at one end thereof and a shaft portion 88 disposed within a bore 90 in a collar member 92. The collar member 92 includes a passageway 94 extending diametrically through it, through the bore 90, and through a hole in the pin 84 to receive a locking, e.g., cotter, linch, etc., pin 96 to rotatably secure the collar 92 on the coupling 74. The opposite end of the collar from the coupling is in the form of a D-ring 98. This D-ring has been mentioned earlier as the means for connecting the rope 20 to the mounting assembly. For example, in the embodiment shown herein the D-ring 98 on the mounting assembly 46 serves to connect that mounting assembly to the sliding connector 54, via a carabiner 50. The D-ring 98 on the other mounting assembly 48 is connected to the eyelet 40A at the other end of the rope 40, via a carabiner 50.

One end of the lower elbow 68 (FIG. 5) is fixedly secured, via a set screw 78, to the lower end of the lower tubular link 72. When so connected the upper and lower tubular links 70 and 72, respectively, of the mounting assembly 46 are free to hang downward from the upper rotatable mounting tube 62, as shown by the phantom lines in FIG. 2. This is the heretofore mentioned retracted position. As can be seen in this position the tubular links 70 and 72 of the mounting assembly 46 lie behind and closely adjacent the rear surface of the side 28C of the billboard.

Figure 5:
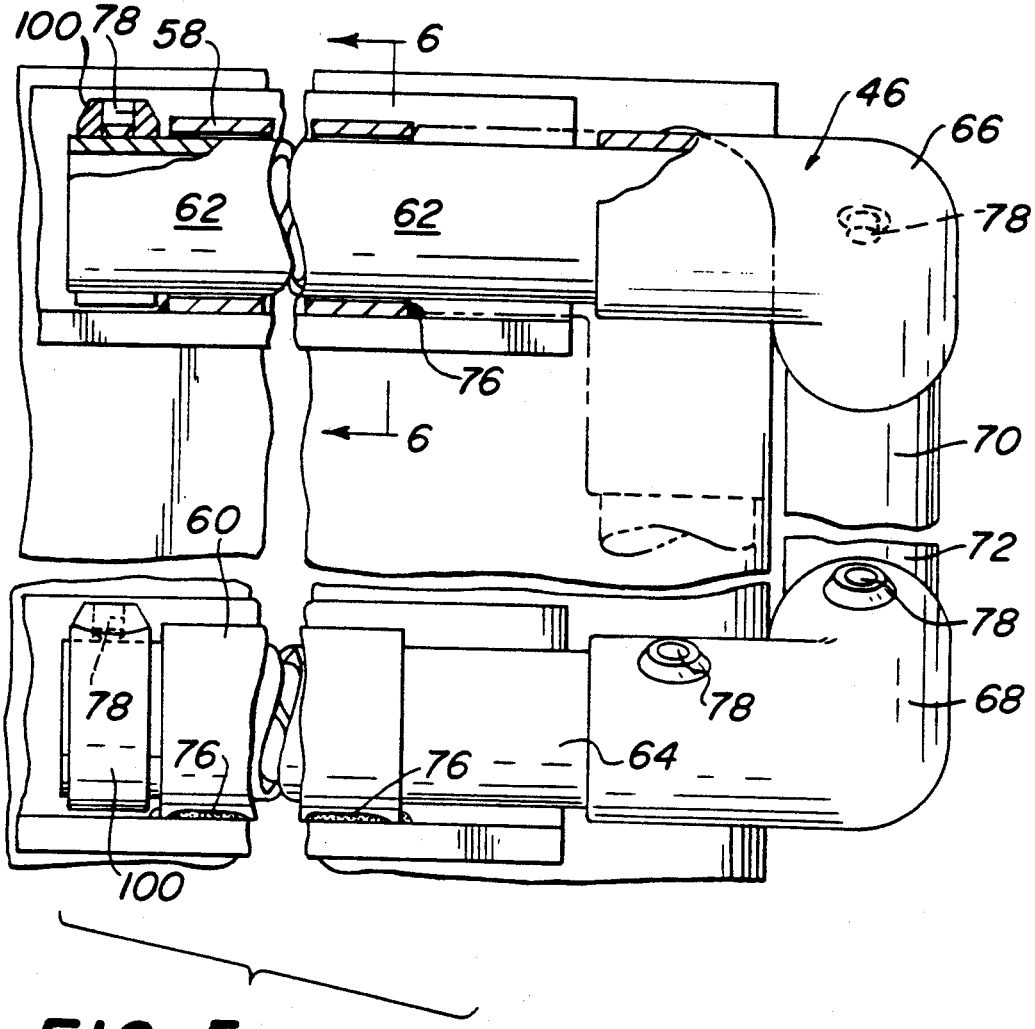
FIG. 5 is an enlarged rear plan view, partially in section, of a portion of the billboard and fall prevention system shown in FIG. 1.
Figure 6:
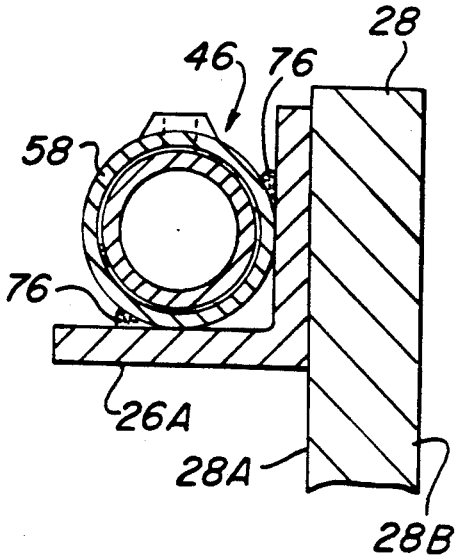
FIG. 6 is an enlarged sectional view taken along line 6—6 of FIG. 5.

The extension of the mounting assembly's tubular links 70 and 72 to the extended position is accomplished by sliding the rotatable mounting tube 62 slightly outward of its associated fixed mounted tube 58 from the phantom line position, shown in FIG. 5, to the solid line position shown therein, whereupon the links 70 and 72 are located beyond the edge of the billboard panel. The lower link 72 is then grasped and moved upward whereupon the links 70 and 72 pivot with respect to each other about the axis of the coupling 74. The worker positions the links until the open end of the lower elbow 68 is aligned with the free end of the lower rotatable mounting tube 74. When this has been accomplished the free end of the lower rotatable mounting tube 64 is inserted in the open end of the lower elbow by sliding it longitudinally outward with respect to its associated fixed mounting tube 60. The set screw 78 is then tightened to secure the rotatable mounting tube 64 in the lower elbow. This action holds the links in the extended orientation shown in FIGS. 1, 2 and 3. In this orientation the D-ring 98 on the collar 92 is located spaced in front of the front surface of the billboard immediately adjacent the side 26C. As mentioned earlier it is this D-ring which serves as the means for connecting the safety line 40 to the mounting assembly 46.

In order to prevent the rotatable mounting tubes 62 and 64 from sliding further out of the fixed mounting tubes 58 and 60, respectively, than that necessary to clear the side edge of the billboard panel, a locking member is provided. Accordingly, the inner end of each rotatable mounting tube extends beyond the inner end of its associated fixed mounting tube and includes a locking collar 100 (FIG. 5) secured thereto by a set screw 78 (FIG. 5).

Figure 4:
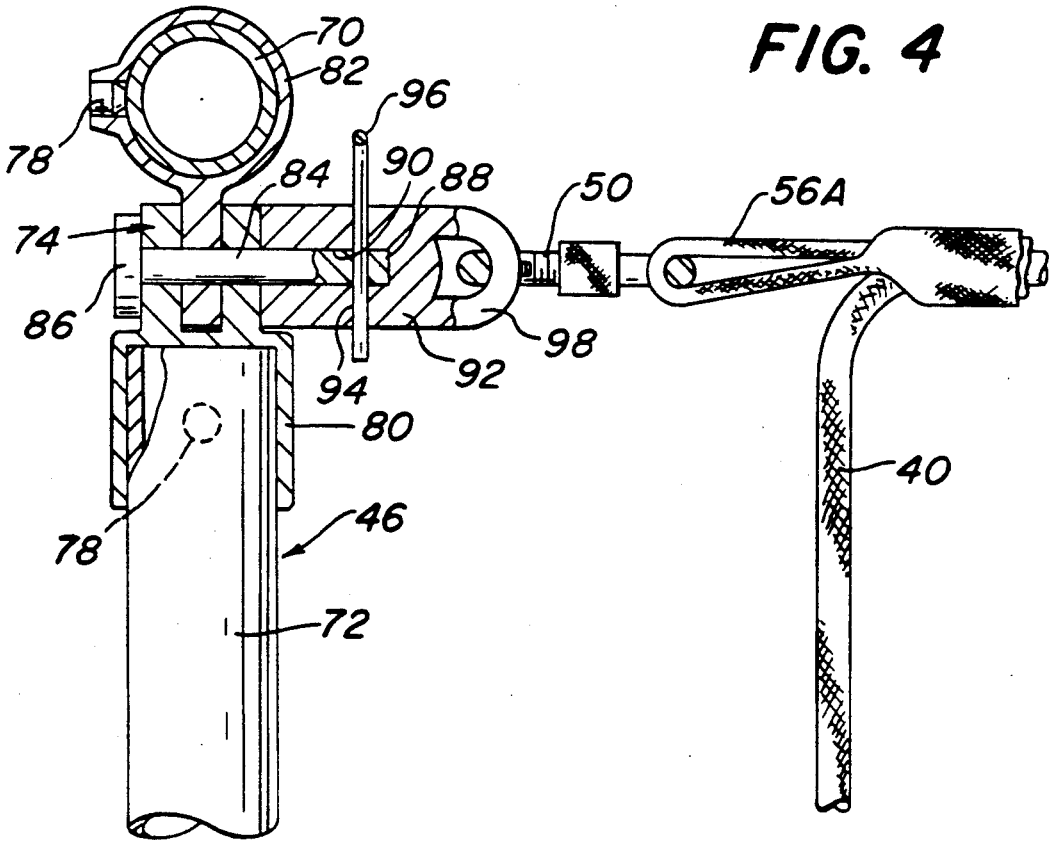
FIG. 4 is an enlarged sectional taken along line 4-4 of FIG. 2.

The details of the frictional engagement connector 59 will now be discussed with reference to FIGS. 3 and 4. The tubular member making up the frictional engagement connector is formed of plural strands of a strong, lightweight, material which are woven or interconnected like a conventional "chinese finger grip" so that the tubular member has a central passageway extending through it between its pair of looped ends 56A and 56B. Portions of tubular members contiguous with the looped ends 56A and 56B include respective openings (not shown) to the interior of the central passageway. The rope 40 extends through these openings and through the central passageway in the tubular member. In order to position and fix the frictional engagement connector 54 on the rope 40 at a desired position, its two ends 56A and 56B are pushed toward each other. This causes the elongated tubular member to decrease in length and increase in internal diameter, so that the internal diameter of its central passageway is greater than the external diameter of the rope. This enables the frictional engagement connector to be readily slid to the desired position on the rope. To fix or secure the connector at that position so that it cannot slide with respect to the rope, all that is necessary is for the worker 32 to pull the ends of the connector apart by gripping its loops and pulling them away from each other. This action causes the connector to elongate, and its central passageway to constrict in internal diameter, whereupon, the interior surface of the central passageway tightly engages the exterior surface of the rope. The resulting high friction created by this action precludes the connector from sliding along the rope.

In accordance with a preferred embodiment of this invention the rope 40 is connected between the two mounting assemblies 46 and 48, but is left slack when the assemblies are in their stowed or retracted condition. In such a case the rope is arranged to be disposed along the lower edge of the billboard panel. The rope can be held in place out of view by any type of suitable means, e.g., clips, etc., in the interest of aesthetics. When a worker will be working on the billboard all that is required is to release the clips holding the rope in place. The mounting assemblies can then be moved to their extended positions, and the rope tightened by use of the frictional engagement connector 54. The system 20 is now ready for the worker to connect thereto. In particular, the worker can then connect himself/herself to the rope 40 by securing a connector, e.g., a conventional D-ring 102, which is mounted on his/her safety belt 36 or harness to a connector 104 mounted on one end of the lanyard 38. The other end of the lanyard is connected, via a connector 106 secured thereto, to the sliding connector, e.g., a ring 42, on the rope 40.

As should be appreciated by those skilled in the art, once the worker is connected, he/she may freely move about the entire front surface of the billboard by either walking on the ledge 30 or standing on the ladder 34, all the while being protected from a fall.

Without further elaboration the foregoing will so fully illustrate my invention that others may, by applying current or future knowledge, adopt the same for use under various conditions of service.

I claim:

1. A system for preventing a worker from falling off of a billboard having a front surface, a rear surface and a pair of sides, said system comprising safety rope means, and a pair mounting assemblies, each of said mounting assemblies being mountable adjacent a respective side of said billboard and comprising connector means for securing said safety rope means thereto, each of said mounting assemblies comprising first and second elongated members pivotally connected together at a pivot point, and being movable between a stowed position and an extended position and vice versa, said connector means being located closely adjacent said rear surface of said billboard when its associated mounting assembly is in said stowed position, and being located spaced in front of said front surface when its associated mounting assembly is in said extended position, said rope means being connected between said connector means, whereupon said rope may serve as an anchor point to which a safety device worn by a worker may be releasably secured.

2. The system of claim 1 wherein each of said first and second elongated members comprises a link, wherein said links are pivotally connected together at a pivot point, and wherein said connecting means is located adjacent said pivot point.

3. The system of claim 2 wherein said first and second links extend substantially coaxially with each other along said side of said billboard when said mounting assembly is in said retracted position, and wherein said first and second links extend at an angle to each other when said mounting assembly is in said extended position.

4. The system of claim 2 wherein said mounting assemblies comprise a first member, said first member being elongated and having a longitudinal axis, said first member being mounted generally horizontally on the rear of said panel for rotation about said axis, said first link being coupled to said first member.

5. The system of claim 4 wherein said mounting assemblies additionally comprise a second member, said second link being arranged to be coupled to said second member when said mounting assembly is in said extended position.

6. The system of claim 5 wherein said first member is arranged to be slid along said longitudinal axis to enable said first and second links to be pivoted with respect to each other to be in said extended position.

7. The system of claim additionally comprising means to enable said rope to be held taut between said connector means.

8. The system of claim 7 wherein said means to enable said rope to be held taut between said connector means comprises a slidable frictional engagement connector.

9. The system of claim 6 additionally comprising means to enable said rope to be held taut between said connector means.

10. The system of claim 9 wherein said means to enable said rope to be held taut between said connector means comprises a slidable frictional engagement connector.

* * * * *